US008596920B2

(12) United States Patent
DuBose

(10) Patent No.: US 8,596,920 B2
(45) Date of Patent: Dec. 3, 2013

(54) APPARATUS AND METHOD FOR A SHIELDING A PILE

(76) Inventor: Darla DuBose, Humble, TX (US)

( * ) Notice: Subject to any disclaimer, the term of this patent is extended or adjusted under 35 U.S.C. 154(b) by 0 days.

(21) Appl. No.: 13/271,547

(22) Filed: Oct. 12, 2011

(65) Prior Publication Data

US 2013/0156508 A1 Jun. 20, 2013

(51) Int. Cl.
*E02D 5/60* (2006.01)
*E02D 31/00* (2006.01)
*F21S 8/00* (2006.01)

(52) U.S. Cl.
USPC ..... 405/216; 362/189

(58) Field of Classification Search
USPC ..... 405/216, 75, 76; 52/28; 362/145, 189
See application file for complete search history.

(56) References Cited

U.S. PATENT DOCUMENTS

| | | | | | |
|---|---|---|---|---|---|
| 3,321,924 | A * | 5/1967 | Liddell | 405/216 |
| 4,068,483 | A | 1/1978 | Papworth | |
| 4,244,156 | A * | 1/1981 | Watts, Jr. | 52/746.1 |
| 4,764,054 | A | 8/1988 | Sutton | |
| 5,408,782 | A | 4/1995 | McConnell | |
| 5,435,667 | A | 7/1995 | Strange | |
| 5,586,838 | A | 12/1996 | Walsh | |
| 7,300,229 | B1 | 11/2007 | Fyfe | |
| D583,082 | S | 12/2008 | Baxter | |
| 2008/0007960 | A1 | 1/2008 | Jordan | |
| 2009/0261295 | A1 * | 10/2009 | Goedel | 252/301.36 |
| 2010/0021240 | A1 | 1/2010 | Castroglovanni | |
| 2011/0070454 | A1 | 3/2011 | Gregg | |

* cited by examiner

*Primary Examiner* — David Bagnell
*Assistant Examiner* — Kyle Armstrong
(74) *Attorney, Agent, or Firm* — G. Michael Roebuck PC

(57) ABSTRACT

An apparatus is disclosed including but not limited to a cylindrical sleeve having an interior surface and an exterior surface, wherein a diameter of a circular interior vacancy formed by the interior surface has a diameter substantially equal to a diameter of a pile; a longitudinal opening along an entire length of the sleeve; and a plurality of elements that emit energy on the exterior surface of the sleeve. A method is also disclosed for using the apparatus.

8 Claims, 3 Drawing Sheets

APPARATUS AND METHOD FOR A SHIELDING A PILE

FIELD OF THE INVENTION

This invention relates to the protection of piles or risers, such as those of oil rigs, piers or jetties. For convenience, the specification will simply refer to piles.

BACKGROUND OF THE INVENTION

Piles are usually massive steel tubing, or concrete or wooden support members and submerged in water. Although the pile may initially be painted or otherwise coated to avoid wear and tear from the elements, the piles inevitably become subject to corrosion, barnacles and/or bacterial attack in the fresh water or the hostile environment of sea water. This is particularly so over the splash zone, near the surface of the water in which the pile is partially submerged, where the pile is alternately wetted and dried by the wave action of surface of the water in which the pile is submerged.

It is comparatively easy to apply a protective shield to a pile before it is placed in the water, however, there are thousands of existing piles already in place, corroding away and in need of a protective shield. Moreover, existing shielding systems make retrofitting existing piles with a shield, extremely difficult and expensive. Thus, there is a need for a somewhat simpler shield, and one that will allow fairly easy replacement or retrofitting, or even re-use after removal inspection.

SUMMARY OF THE INVENTION

In a particular illustrative embodiment, an apparatus is disclosed including but not limited to a cylindrical sleeve having an interior surface and an exterior surface, wherein a diameter of a circular interior vacancy formed by the interior surface of the cylindrical sleeve has a diameter substantially equal to a diameter of a pile; a longitudinal opening along an entire length of the sleeve; and a plurality of elements on the exterior surface of the sleeve that emit energy. A method is also disclosed for using the apparatus.

BRIEF DESCRIPTION OF THE DRAWINGS

For a better understanding of the invention, one embodiment will now be described, by way of example, with reference to the accompanying drawing, in which.

DETAILED DESCRIPTION

Figure 1:
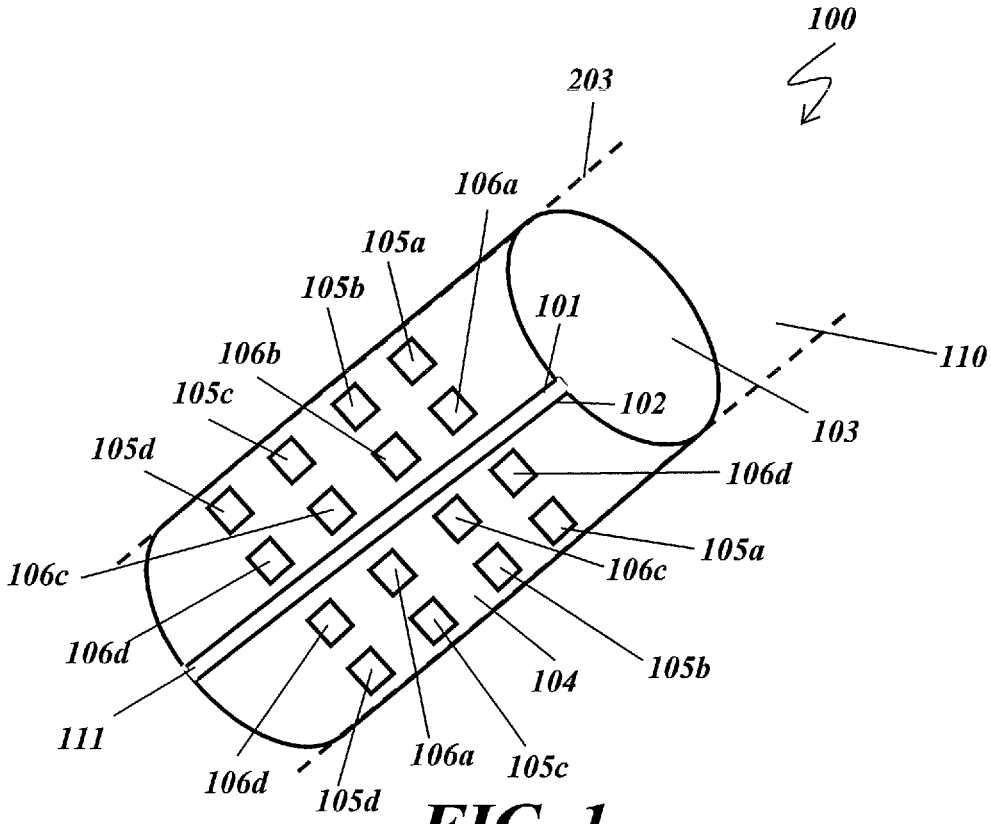
FIG. 1 is a perspective view of an apparatus in one particular illustrative embodiment.

In a particular embodiment, an apparatus is disclosed including but not limited to a cylindrical sleeve having an interior surface and an exterior surface, wherein a diameter of a cylindrical interior vacancy formed by the interior surface of the sleeve has a diameter substantially equal to a diameter of a pile; a longitudinal opening along an entire length of the sleeve; and a plurality of elements that emit energy on the exterior surface of the sleeve. In another particular embodiment, the elements are phosphorescent elements and the sleeve is positioned surrounding the pile and at least partially submerged in water. In another particular embodiment, the elements are electronic light emitters, the cylindrical sleeve further including but not limited to a plurality of piezoelectric elements on the exterior surface of the sleeve that generate electricity from pressure wave action of water against the piezoelectric elements on the exterior surface of the sleeve; and an electrical storage device in electrical communication with the piezoelectric elements and the electronic light emitters. In another particular embodiment; the electric storage device activates the piezoelectric elements to emit vibrations into the water.

In another particular embodiment, the apparatus further includes but is not limited to, a processor in data communication with the piezoelectric elements, wherein the processor pulses the piezoelectric elements off and according to a predetermined pattern of individual elements and groups of individual elements. In another particular embodiment, the apparatus further includes but is not limited to a processor in data communication with the piezoelectric elements, wherein the processor electrically provides power to and excites the piezoelectric elements as a wave that moves along circumferential rows of the piezoelectric elements along the longitudinal axis of the sleeve.

In another particular embodiment, a method is disclosed, the method including but not limited to substantially surrounding a piling with a sleeve having an interior surface and an exterior surface, wherein a diameter of a cylindrical interior vacancy formed by the interior surface has a diameter substantially equal to a diameter of a pile by widening a longitudinal opening along an entire length of the sleeve sufficiently to slip around a diameter of the piling; and energizing a plurality of elements that emit energy on the exterior surface of the sleeve. In another particular embodiment of the method the elements are phosphorescent elements. In another particular embodiment, the method further includes but is not limited energizing the phosphorescent elements by sun light incident upon the phosphorescent elements. In another particular embodiment, the method further includes but is not limited generating electrical energy from a plurality of piezoelectric elements on the exterior surface of the sleeve that generate electricity from pressure wave action of the water against the piezoelectric elements on the exterior surface of the sleeve; and storing the electrical energy generated by the piezoelectric devices in an electrical storage device in electrical communication with the piezoelectric elements and the electronic light emitters.

In another particular embodiment, the method further includes but is not limited to activating the piezoelectric elements to emit vibrations into the water. In another particular embodiment, the method further includes but is not limited to pulsing the piezoelectric elements off and according to a predetermined pattern. In another particular embodiment, the method further includes but is not limited to exciting the piezoelectric elements as a wave along the longitudinal axis of the sleeve.

In another particular illustrative embodiment, the apparatus will further include but is not limited to the loading of polychloroprene rubber (forming the outer or only skin) with conductive particles of the type used in the construction of sacrificial anodes.

An alternative approach is to make the wrapping, as a single or multi-skin jacket, of materials that will give it a very high dielectric constant; this alone should be a cathodic protection device. Both forms will provide a flexible anode assembly or a shield by which cathodic protection effects could be directed into suspected vulnerable areas of subsea structures.

In a particular illustrative embodiment, the flexible shield is used as a mounting platform for a plurality of phosphorescent elements that emit electromagnetic energy into the surrounding water in which the shield surrounding a pile is submerged. Phosphorescence is a specific type of photoluminescence related to fluorescence. Unlike fluorescence, a phosphorescent material does not immediately re-emit the radiation it absorbs. The slower time scales of the re-emission are associated with "forbidden" energy state transitions in quantum mechanics. As these transitions occur very slowly in certain materials, absorbed radiation may be re-emitted at a lower intensity for up to several hours after the original excitation. Commonly seen examples of phosphorescent materials are the glow-in-the-dark toys, paint, and clock dials that glow for some time after being charged with a bright light such as in any normal reading or room light. Typically the glowing then slowly fades out within minutes (or up to a few hours) in a dark room.

In another embodiment piezoelectric elements are provided on the outer surface of the shield. The piezoelectric elements generate electrical energy from wave action of the water incident upon the outer shield surface. The electrical energy is stored and used to power the piezoelectric elements to vibrate and emit pressure waves into the water at a frequency of vibration. In another embodiment the energy emitting elements are light emitting diodes provided on the outer surface of the shield.

In another embodiment, the sleeve substantially surrounds the pile, which is cylindrical. The sleeve may also be adapted to form an element of a cathodic protection system, being a carrier for sacrificial anode material, or forming a jacket with a high dielectric constant, for example. It could also carry anti-fouling material on the exterior surface of the sleeve. The apparatus may also be a square sleeve that surrounds a square pile or support member.

Figure 2:
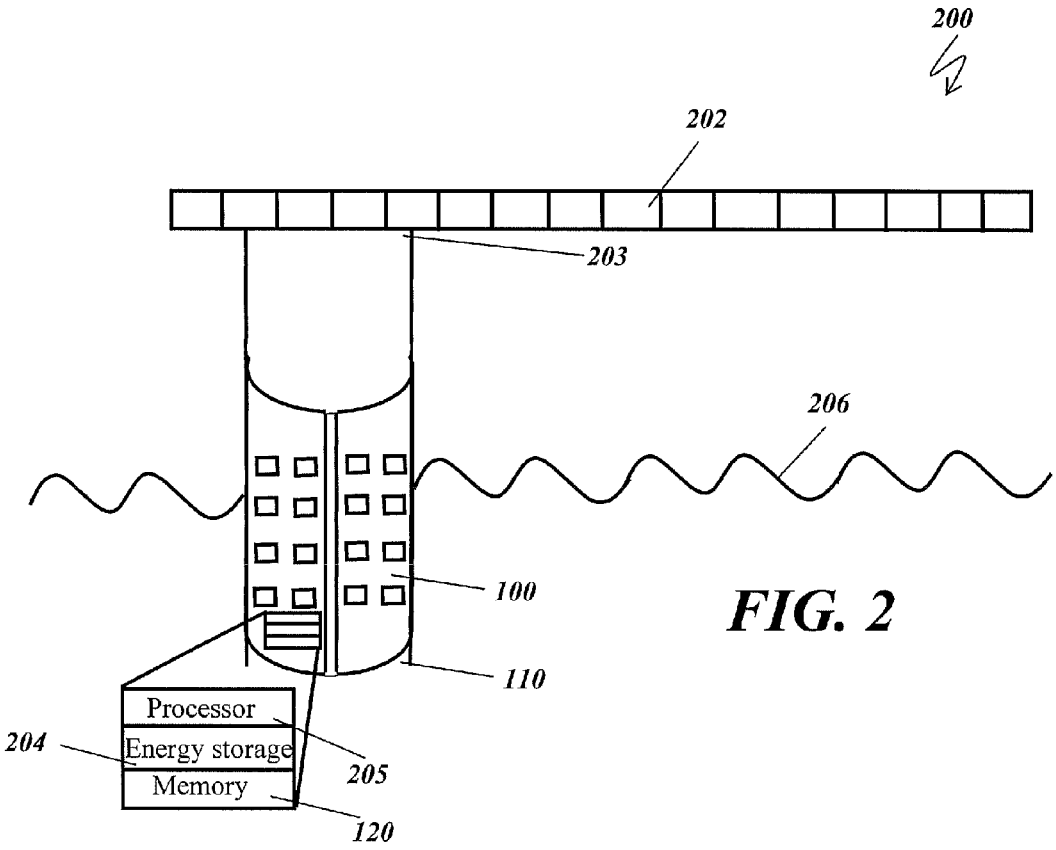
FIG. 2 is a side view of an apparatus in another one particular illustrative embodiment installed on a partially submerged piling.

Turning now to FIG. 1, in a particular illustrative embodiment, the apparatus is disclosed as a cylindrical sleeve 100 shaped and sized to slip around the pile 110. The sleeve has a longitudinal opening 111 along the length of the sleeve formed by unattached sleeve edges 101 and 102. The longitudinal opening 111 formed between unattached sleeve edges 101 and 102 is widened to slide around a pile diameter (as shown in FIG. 2) so that the sleeve substantially surrounds the pile. In another embodiment, the sleeve surrounds more than one half the circumference of the pile to keep the sleeve on the pile once positioned on the pile. The sleeve interior surface 103 contacts the pile exterior surface. Longitudinal oriented rows of energy emitting elements 106 are provided on the exterior surface 104 of the sleeve 100. In a particular embodiment the energy emitting elements are phosphorescent elements that emit light. In another illustrative embodiment the energy emitting elements are light emitting diodes. In another illustrative embodiment the energy emitting elements are electromagnetic coils that emit an electromagnetic field into the water. In another illustrative embodiment the energy emitting elements are piezoelectric elements that vibrate when activated and emit vibrations at a frequency of activation.

In another particular embodiment, longitudinally oriented rows of piezoelectric elements 105 are provided on the sleeve exterior surface. The rows of longitudinal elements generate electricity from incident variations in pressure due to wave action of water into which the pile and sleeve are submerged. In a particular embodiment, the sleeve is positioned half way submerged in water to take advantage of surface wave action which alternately covers and under covers the piezoelectric elements on the sleeve.

Turning now to FIG. 2, in another particular embodiment the apparatus 100 is deployed on a pier 202 pile 111 wherein the apparatus is partially submerged under the surface of water 206. In another embodiment, the apparatus substantially surrounds the pier pile and is positioned along the length of the pier pile at a height so that the apparatus is wholly submerged under the surface of the water. In another particular embodiment, a processor 205 and an energy storage device 204 are also provided. In one particular embodiment, the energy storage device is a capacitor. The processor further includes a non-transitory computer readable medium 120 for containing a computer program. The computer program includes but is not limited to instructions that when executed by the processor perform functions.

Figure 3:
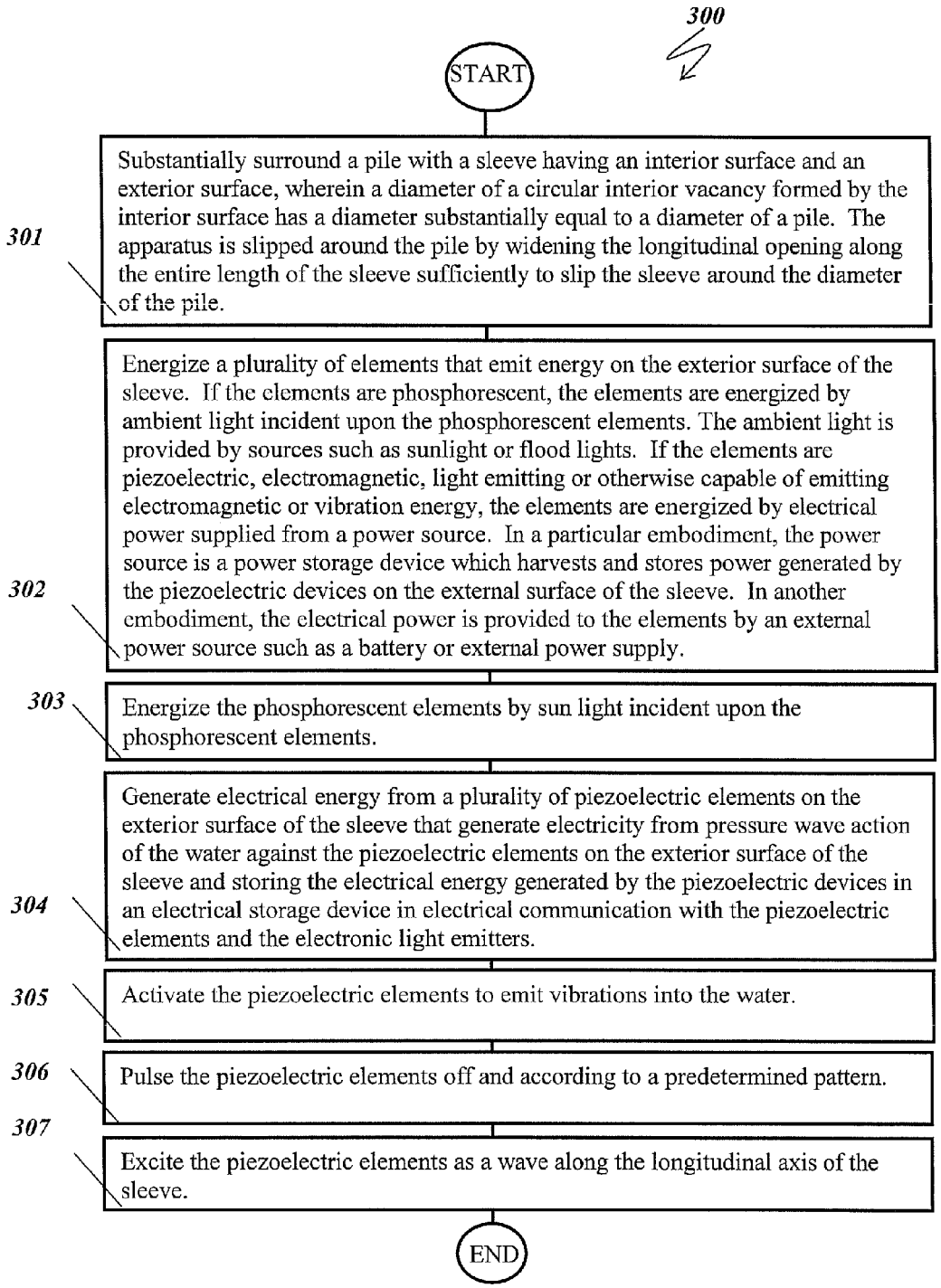
FIG. 3 is a flow chart for performing a method in a particular illustrative embodiment.

Turning now to FIG. 3, a flow chart is depicted show exemplary steps performed in a particular illustrative embodiment. No particular order is implied by the flow chart or description of the flow chart as steps can be performed in any order. Moreover, particular acts shown in FIG. 3, can be left out of the method depending upon the particular embodiment the invention implemented. As shown in FIG. 3, at block 301 in a particular illustrative embodiment, the method begins by substantially surrounding a piling with a sleeve having an interior surface and an exterior surface, wherein a diameter of a cylindrical interior vacancy formed by the interior surface has a diameter substantially equal to a diameter of a pile. The apparatus is slipped around the pile by widening the longitudinal opening along the entire length of the sleeve sufficiently to slip the sleeve around the diameter of the pile. In, block the 302 in a particular illustrative embodiment, the method proceeds with energizing a plurality of elements that emit energy on the exterior surface of the sleeve. If the elements are phosphorescent, the elements are energized by ambient light incident upon the phosphorescent elements. The ambient light is provided by sources such as sunlight or flood lights. If the elements are piezoelectric, electromagnetic, light emitting or otherwise capable of emitting electromagnetic or vibration energy, the elements are energized by electrical power supplied from a power source. In a particular embodiment, the power source is a power storage device which harvests and stores power generated by the piezoelectric devices on the external surface of the sleeve. In another embodiment, the electrical power is provided to the elements by an external power source such as a battery or external power supply.

As shown in block 303, in a particular illustrative embodiment, the method proceeds with energizing the phosphorescent elements by sun light incident upon the phosphorescent elements. In block 304 in a particular illustrative embodiment, the method proceeds with generating electrical energy from a plurality of piezoelectric elements on the exterior surface of the sleeve that generate electricity from pressure wave action of the water against the piezoelectric elements on the exterior surface of the sleeve and storing the electrical energy generated by the piezoelectric devices in an electrical storage device in electrical communication with the piezoelectric elements and the electronic light emitters. In block 305 the method proceeds with activating the piezoelectric elements to emit vibrations into the water. In block 306 in a particular illustrative embodiment, the method proceeds with pulsing the piezoelectric elements off and according to a predetermined pattern. In another embodiment the energy emitting elements are pulsed on and off in a predetermined pattern. In another embodiment the energy emitting elements are pulsed on and off in a random pattern. In block the 307 the method proceed with exciting the piezoelectric elements as a wave along the longitudinal axis of the sleeve.

In another embodiment, the apparatus is used as a carrier for anti-foulant materials, preventing marine growth build up and consequent increase in current drag forces on sub sea platform legs, risers and caissons. This could be achieved by providing an additional outer skin, conveniently a foamed polymer matrix for the anti-foulant material, such as copper particles. If used solely for this purpose the inner sealant layer could be dispensed with. It will be understood however, that a single wrapping could combine any of these functions.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A cylindrical apparatus comprising:

a cylindrical sleeve having an interior surface and an exterior surface, wherein a diameter of a cylindrical interior vacancy formed by the interior surface has a diameter substantially equal to a diameter of a pile;

a longitudinal opening along an entire length of the sleeve; and a plurality of energy emitting elements that emit energy on the exterior surface of the sleeve wherein the first plurality of energy emitting elements are electrical powered light emitters, the cylindrical sleeve further comprising:

a plurality of piezoelectric elements on the exterior surface of the sleeve that generate electricity from pressure wave action of the water against the piezoelectric elements on the exterior surface or the sleeve; and an electrical storage device in electrical communication with the piezoelectric elements and the electrical powered light emitters.

2. The apparatus of claim 1, wherein the electric storage device activates the piezoelectric elements to emit vibrations into the water.

3. The apparatus of claim 2, that apparatus further comprising:

a processor in data communication with the energy emitting elements, wherein the processor pulses some of the plurality of energy emitting elements off and on according to a predetermined pattern.

4. The apparatus of claim 2, that apparatus further comprising:

a processor in data communication with the piezoelectric elements, wherein the processor excites the piezoelectric elements as a wave along the longitudinal axis of the sleeve.

5. A method comprising:

substantially surrounding a piling with a sleeve having an interior surface and an exterior surface, wherein a diameter of a circular interior vacancy formed by the interior surface has a diameter substantially equal to a diameter of a pile by widening a longitudinal opening along an entire length of the sleeve sufficiently to slip around a diameter of the piling;

energizing a plurality of elements that emit energy on the exterior surface of the sleeve;

generating electrical energy from a plurality of piezoelectric elements on the exterior surface of the sleeve that generate electricity from pressure wave action of the water against the piezoelectric elements on the exterior surface of the sleeve; and storing the electrical energy generated by the piezoelectric devices in an electrical storage device in electrical communication with the piezoelectric elements and the electronic light emitters.

6. The method of claim 5, the method further comprising:

activating the piezoelectric elements to emit vibrations into the water.

7. The method of claim 6, that apparatus further comprising:

pulsing the piezoelectric elements off and according to a predetermined pattern.

8. The method of claim 6, that apparatus further comprising:

exciting the piezoelectric elements as a wave along the longitudinal axis of the sleeve.

* * * * *